United States Patent [19]

Wenkman et al.

[11] Patent Number: 4,782,972

[45] Date of Patent: Nov. 8, 1988

[54] COLLAPSIBLE FILE BOX

[75] Inventors: Gregory J. Wenkman, Middleton; Ferdinand F. Salzmann, Prairie du Sac, both of Wis.

[73] Assignee: Traex Corporation, Dane, Wis.

[21] Appl. No.: 879,906

[22] Filed: Jun. 30, 1986

[51] Int. Cl.[4] ..... B65D 6/22

[52] U.S. Cl. ..... 220/4 F; 220/22.5; 220/94 A; 312/257 R; 312/263; 312/264; 52/284

[58] Field of Search ..... 206/425, 600, 507; 220/4 F, 23.4, 22.3, 22.5, 94 A, 4 E; 312/257, 263, 264; 52/284, 263, 264

[56] References Cited

U.S. PATENT DOCUMENTS

| | | | |
|---|---|---|---|
| D. 249,744 | 9/1978 | Weston . | |
| D. 265,743 | 8/1982 | Meyer et al. . | |
| 1,050,409 | 4/1916 | Wadsworth et al. . | |
| 3,069,002 | 5/1963 | Hart . | |
| 3,093,259 | 6/1963 | Morrison | 220/4 F |
| 3,410,441 | 11/1968 | Rhyne | 220/4 F |
| 3,630,387 | 12/1971 | Wehner . | |
| 3,724,920 | 10/1973 | Beck . | |
| 3,727,785 | 4/1973 | Lutz | 220/4 F |
| 3,788,718 | 1/1974 | Biorn et al. . | |
| 3,982,650 | 9/1976 | Ichihara | 220/4 F |
| 3,987,924 | 10/1976 | Uitz | 220/4 F |
| 4,002,261 | 1/1977 | Litchfield | 220/4 F |
| 4,173,287 | 11/1979 | Kumakaw | 52/284 |
| 4,238,044 | 12/1980 | Roddier | 220/4 F |
| 4,295,571 | 4/1981 | Meyer . | |
| 4,402,397 | 9/1983 | Spence | 206/45.34 |
| 4,542,777 | 9/1985 | Benson | 206/425 |
| 4,561,554 | 12/1985 | Swincicki | 220/345 |
| 4,570,814 | 2/1986 | Seeley | 220/4 F |
| 4,577,773 | 3/1986 | Bitel | 220/22.3 |
| 4,609,116 | 9/1986 | Simms | 220/4 F |
| 4,620,636 | 11/1986 | Herr et al. | 220/23.4 |

*Primary Examiner*—David T. Fidei

*Attorney, Agent, or Firm*—Isaksen, Lathrop, Esch, Hart & Clark

[57] ABSTRACT

A collapsible file box is disclosed which includes a rectangular base, a pair of generally rectangular ends adapted to extend vertically upwardly from the rectangular base, each end further including a plurality of side tabs extending outwardly from each of the two side edges of the end, a pair of generally rectangular sides adapted to extend vertically upwardly from the rectangular base, each side having a plurality of grooves at each of the two side extremities of the side to receive the tabs on the ends so that the tabs may be inserted into the grooves to assemble the collapsible file box only with the sides and ends in correct orientation to each other. The collapsible file box may also include a rectangular lid which is substantially structurally identical to the rectangular base, and may also include upwardly facing side rails on the sides for suspending conventional letter size hanging file folders, and upwardly facing end rails on the ends for suspending conventional legal size hanging file folders. The assembled collapsible file box may have a base, end, sides, and a lid with substantially closed surfaces so that the assembled collapsible file box is substantially dustproof.

15 Claims, 6 Drawing Sheets

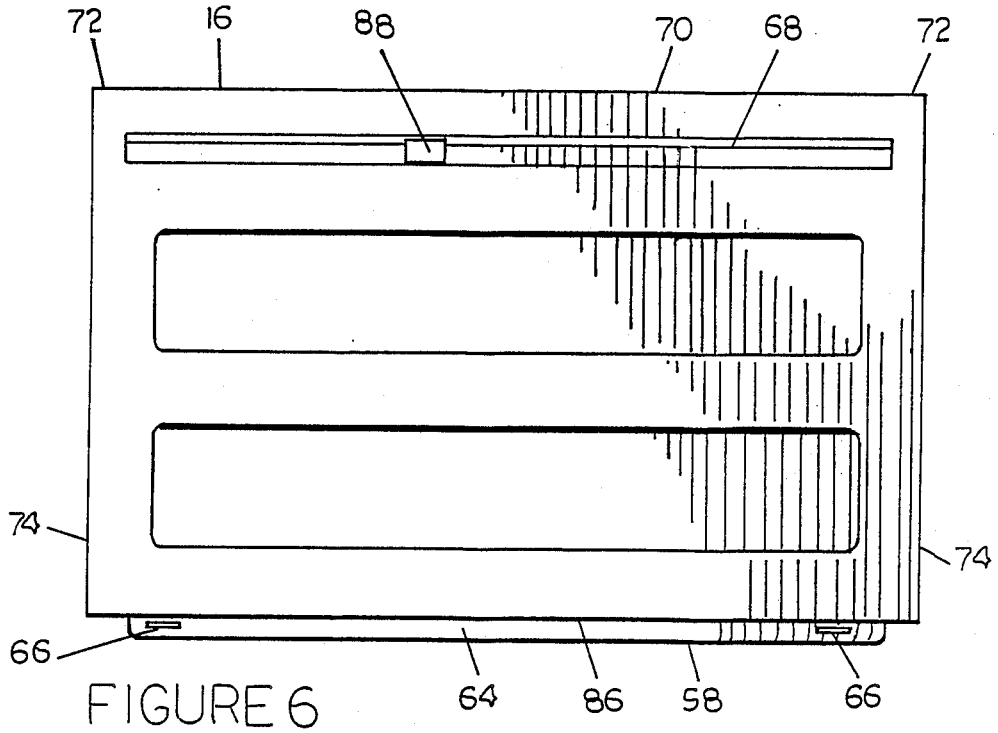
FIGURE 6
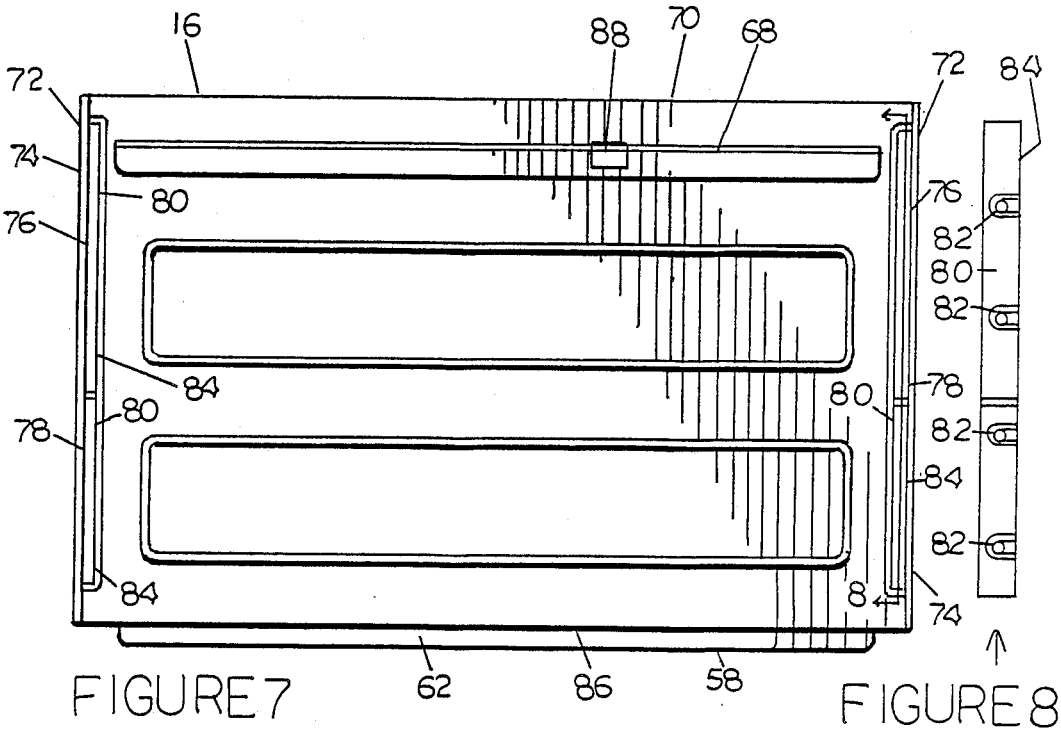
FIGURE 7
FIGURE 8

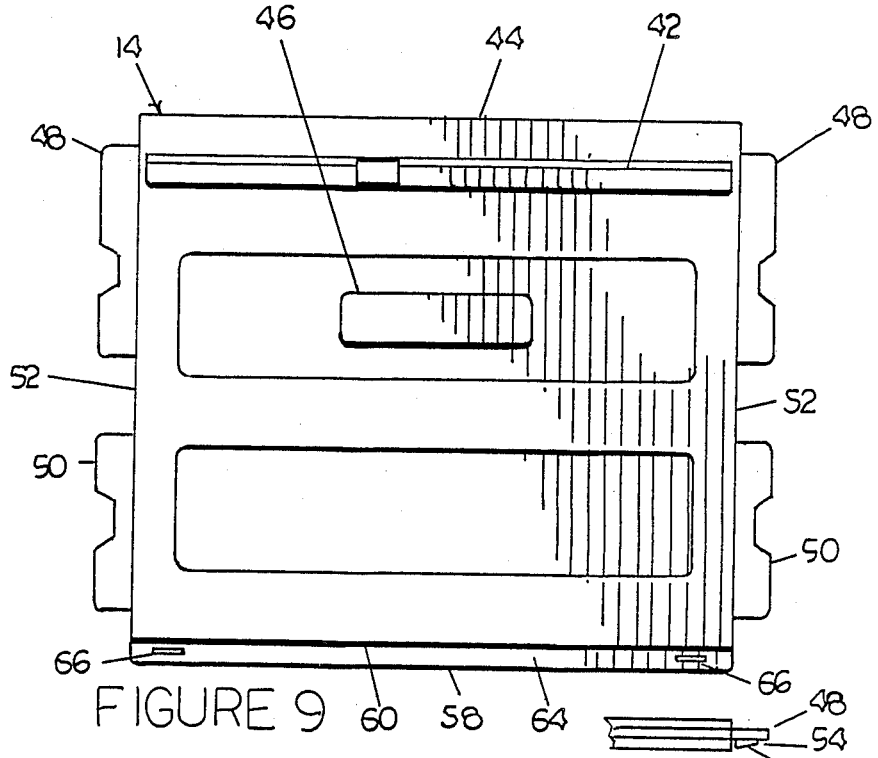
FIGURE 9
FIGURE 11
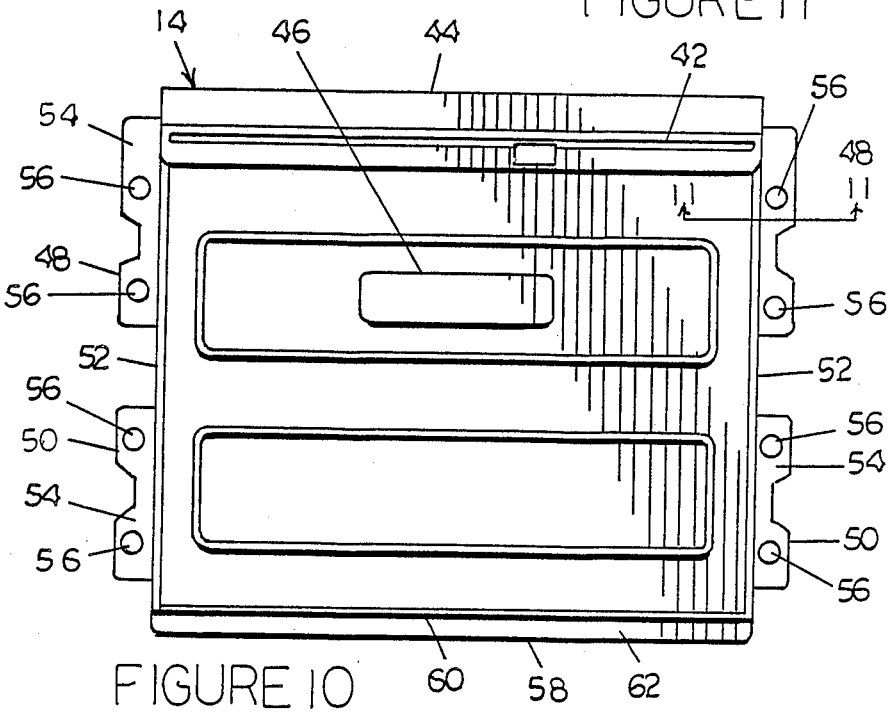
FIGURE 10

COLLAPSIBLE FILE BOX

TECHNICAL FIELD

The present invention relates to a box for the filing of legal and letter size papers and like articles, and more particularly to collapsible file boxes in which legal or letter size hanging file folders may be suspended.

DESCRIPTION OF THE PRIOR ART

Prior to the present invention many different types of file support structures, collapsible file structures, support frames and suspension files have been developed which enable a user to suspend legal and letter size hanging file folders therein. Several different types of such structures exist. Some of the filing structures have a bare frame-like structure having a purpose only to support conventional letter or legal size hanging file folders. Some frame-like structures may be used outside of a file cabinet to temporarily store hanging file folders which have been removed from the file cabinet, and others of these frame structures may be used in conjunction with corrugated boxes or filing cabinets by being placed therein for the more permanent storage of the hanging file folders.

For example U.S. Pat. No. 3,630,387 to Wehner discloses a portable file support structure for the vertical filing of letter and legal size hanging file folders which may sit within a file cabinet, or be used on a desktop, tabletop and the like to provide a file support structure to temporarily store hanging file folders which have been removed from a filing cabinet. The support bars on which the hanging file folders are suspended on the Wehner file support structure are pivotally secured to the upright members of the end frames by rivets or other similar fasteners. U.S. Pat. No. 4,295,571 to Meyer discloses a pair of frame members at each of its ends attached at their center and oriented in a "X", such that they are foldable together with bars joining the tops of the X's to form a cabinet for hanging suspended files. The Meyer file folder support rack comprises bare frame support elements, just as the Wehner file support structure does.

There exists a collapsible device in the prior art which is used for storing, filing and recordkeeping for various types of documents, invoices, letters and the like in conventional hanging file folders. The device includes two end pieces which are pivotally joined to two side support struts on each of two opposite sides. Hanging file folders may be suspended from rails located on the end pieces near the top edges thereof. Each side piece of this device comprises a narrow support strut pivotally joining the two end pieces. The device is collapsed by rotating the end pieces about the points where they are pivotally connected to the support struts thereby flattening out the structure considerably. Since the pivot point is not at the bottom of the end pieces, but rather almost midway up the sides of the end pieces so that when the end piece pivots, the upper portion of the end piece overlies and rests upon the support struts and the bottom portion of the end piece extends horizontally outwardly from the pivot point thereby actually lengthening the amount of space required by the collapsed device. This device has no bottom piece, nor top, and the side struts are of small vertical dimension. Therefore the device is suitable for use only with conventional hanging file folders and any other folders stored within the device will fall out through the bottom or topple out of the sides.

Accordingly, there is a need for a collapsible file box which may be used to contain conventional hanging file folders along with other types of folders and objects, is easily assemblable, and when disassembled requires a minimum of space to store or ship.

SUMMARY OF THE INVENTION

The present invention is summarized in that a collapsible file box includes a rectangular base, a pair of generally rectangular ends adapted to extend vertically upwardly from the rectangular base and each end further includes a plurality of side tabs extending outwardly from each of the two edges of the end, a pair of generally rectangular sides adapted to extend vertically upwardly from the rectangular base and each side further has a plurality of grooves at each of the two extremities of the side to receive the tabs on the ends so that the tabs may be inserted into the grooves to assemble the collapsible file box only with the sides and ends in correct orientation to each other. The two sides and two ends of the collapsible file box each further include an upwardly facing side rail or end rail which is parallel to but below a top edge of the side or end, so that conventional letter size or legal size hanging file folders may be hung from the side or end rails. The collapsible file box may also include a pair of U-shaped anti-slide file position lock pieces which may be fitted snugly over the end or side rails to prevent the sliding of conventional letter or legal size hanging file folders along the side or end rails. The collapsible file box may have sides, ends, base, and lid with substantially closed surfaces so that when assembled, the collapsible file box is substantially dustproof.

A primary object of the invention is to provide a collapsible file box with a bottom, two sides, and two ends so that the collapsible file box will receive and retain conventional hanging file folders and other types of folders as well.

A second object of the invention is to provide a collapsible file box of length and height such that the file box may receive legal size papers and the like therein.

Another object of the invention is to provide a collapsible file box of width and height such that the file box may receive letter size papers and the like therein.

An additional object of the invention is to provide a collapsible file box which is easily assembled.

A further object of the invention is to provide a collapsible file box which when disassembled may be stored or transported with a minimum of air volume and in a space which is not substantially of length greater than the length of the file box when assembled.

Yet another object of the invention is to provide a collapsible file box which is inexpensively manufactured, easily transported, and simple to use.

Yet an additional object of one embodiment of the invention is to provide a collapsible file box which is substantially dustproof.

Yet a further object of the invention is to provide a collapsible file box which is assembled only with the sides and ends in correct orientation to each other.

Other objects, features, and advantages of the invention will be apparent from the following detailed description taken in conjunction with the accompanying drawings wherein a preferred embodiment of the invention has been selected for exemplification.

BRIEF DESCRIPTION OF THE DRAWINGS

FIG. 6 is a side view of the exterior of the side of the collapsible file box.

FIG. 7 is a side view of the interior of a side of the collapsible file box.

FIG. 8 is a cross section view taken along section line 8—8.

FIG. 9 is a front view of the exterior of an end of the collapsible file box.

FIG. 10 is a rear view showing the interior of an end piece of the collapsible file box.

FIG. 11 is a section view taken along section 11—11.

DESCRIPTION OF THE PREFERRED EMBODIMENT

Figure 1:
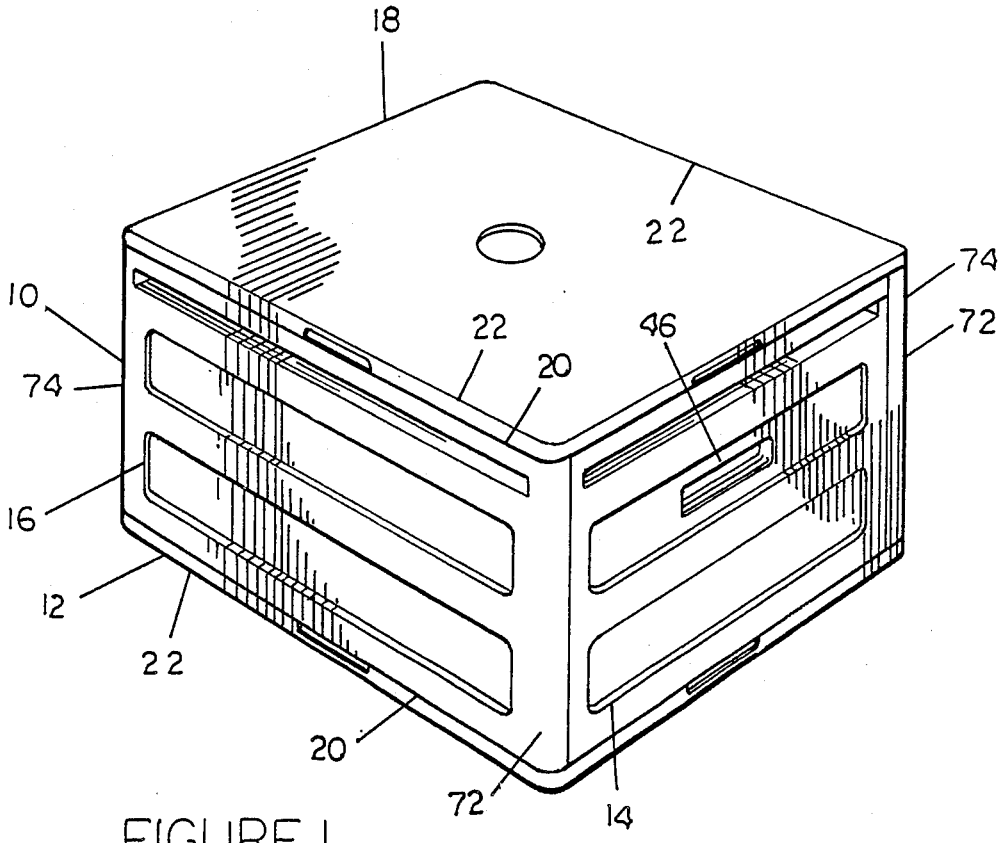
FIG. 1 is a perspective view of a collapsible file box according to the present invention.
Figure 2:
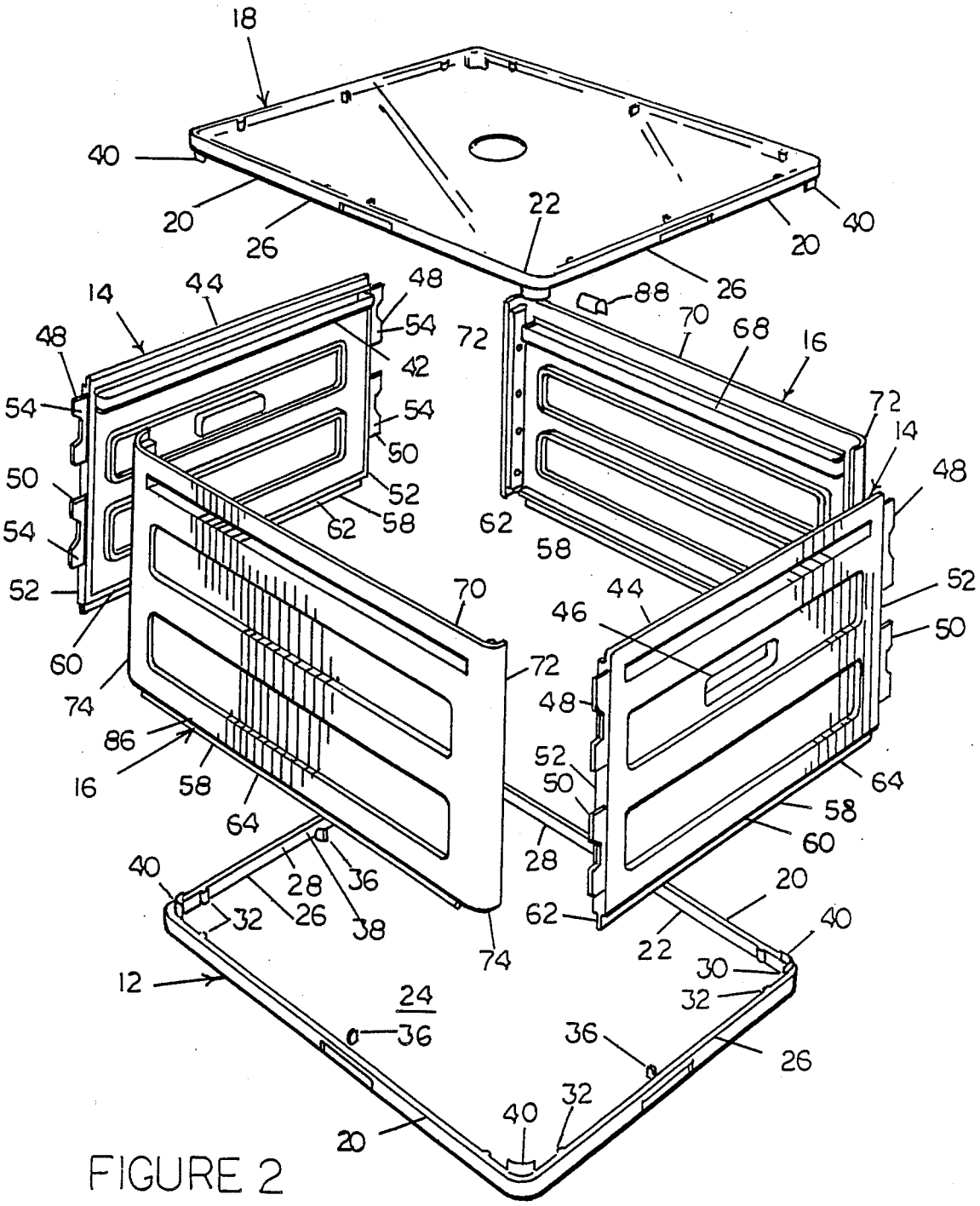
FIG. 2 is an exploded perspective view of a collapsible file box according to the present invention, in a configuration for assembly.
Figure 4:
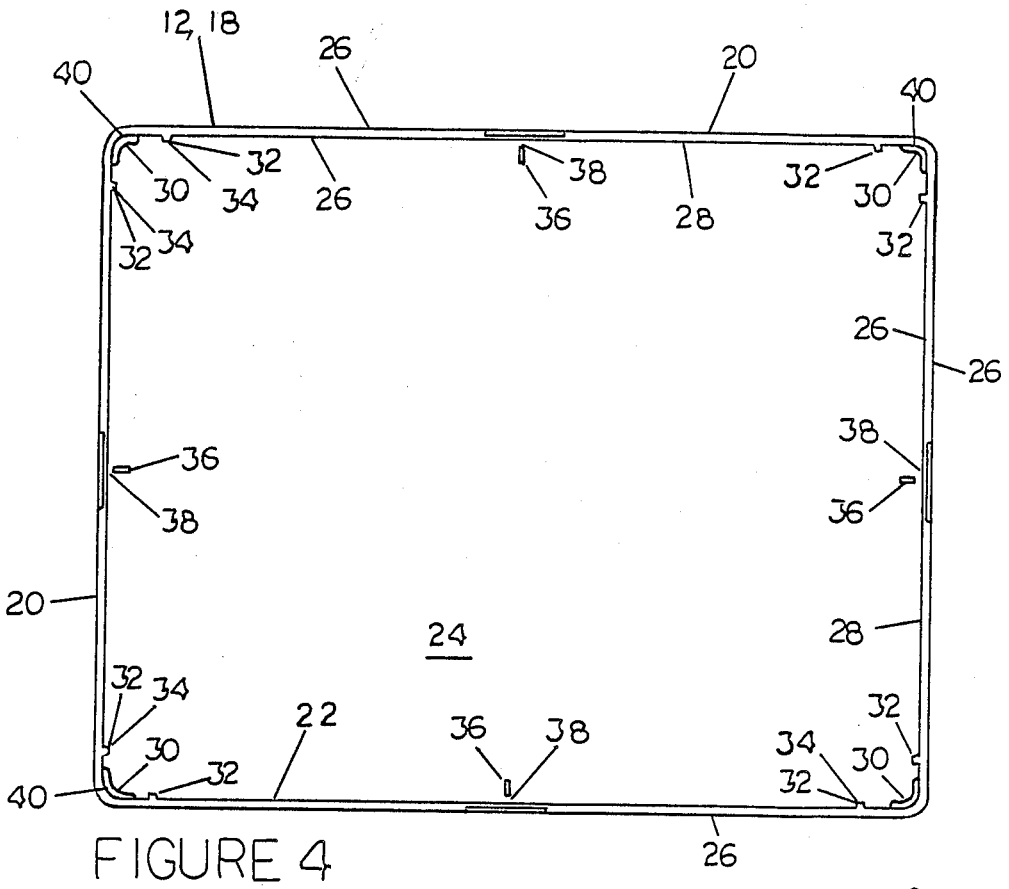
FIG. 4 is both a bottom view of the rectangular lid or a plan view of the rectangular bottom.
Figure 5:
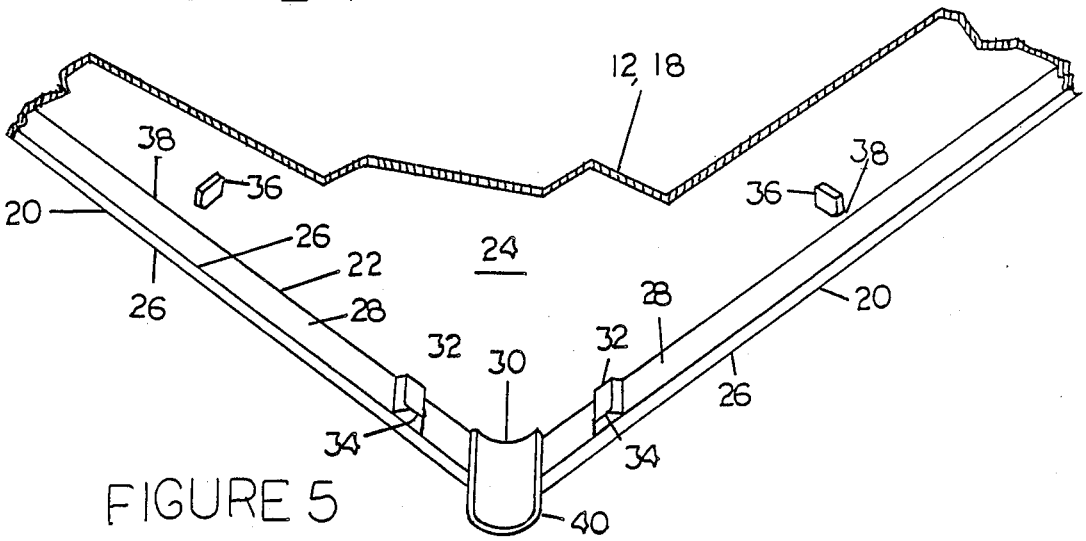
FIG. 5 is a perspective view of a portion of a lid or bottom, looking at the two inside faces and inside corner of the skirt on the inside surface of the base or lid.

Referring more particularly to the drawings wherein like numbers refer to like parts, FIGS. 1 and 2 show a collapsible file box 10 having a rectangular base 12, a pair of generally rectangular ends 14, a pair of generally rectangular sides 16, and a generally rectangular lid 18. Referring to FIGS. 4 and 5, the preferred rectangular base 12 includes a skirt 20 around its periphery 22 extending normally from the inside surface 24 of the base 12. The skirt 20 includes a skirt edge 26, four inside faces 28, and four inside corners 30. Each inside face 28 on the skirt 20 has two protuberances extending normally therefrom near the inside corners 30. Each protuberance 32 further includes a small protrusion 34 which also is normal to the inside face 28 of the skirt 20 extending from the protuberance 32 near the skirt edge 26. The rectangular base 12 also includes four jutting projections 36 which extend normally from the inside face 24 of the base 12, each of which is located a selected distance from the center 38 of each of the four inside faces 28 of the skirt 20. Furthermore, the rectangular base 12 includes four cornerpiece tabs 40, each of which extends normally from the inside surface 24 of the base 12 to a distance beyond the skirt edge 26. Each cornerpiece tab 40 is molded to one of the four inside corners 30 of the skirt 20.

Referring to FIGS. 9 and 10, the pair of generally rectangular ends 14 is adapted to extend vertically upwardly from a rectangular base and join with the rectangular ends 14. Each end 14 includes an upwardly facing end rail 42 which is parallel to, but below the top edge 44 of the end 14, a handle 46 which is located above the center of the end 14, four side tabs 48, 50 which are substantially co-planar with the end 14. An upper 48 and lower 50 side tab extends outwardly from each of the two side edges 52 of the end 14, the upper side tabs 48 having a different width than the lower side tabs 50. Each side tab 48, 50 includes an inside face 54 with two beveled protrusions 56 as shown in FIG. 10. FIG. 11 demonstrates that the protrusion 56 is beveled downwardly to the inside face 54 of the side tab 48, 50 as one moves outwardly away from the side edge 52 of the end 14. As shown in FIGS. 9 and 10, each rectangular end 14 also includes a bottom tab 58 which extends downwardly from the bottom edge 60 of the end 14. The bottom tab 58 is substantially co-planar to the end 14 and has a thickness which is slightly less than the distance which each jutting projection 36 on the rectangular base 12 is located from the center 38 of the corresponding inside face 28 of the base skirt 20. The bottom tab 58 has an inside face 62, and an outside face 64 which has two small cavities 66 which are located adjacent to the bottom edge 60 of the end 14 from which the bottom tab 58 extends.

Referring to FIGS. 6 and 7, the preferred embodiment of the collapsible file box 10 includes a pair of generally rectangular sides 16 which are adapted to extend vertically upwardly from the rectangular base 12. Each of the two sides 16 includes an upwardly facing side rail 68 which is parallel to, but below the top edge 70 of the side 16, and two cornering portions 72, one of which is located at each side extremity 74 of each rectangular side 16. Each of the two cornering portions 72 on the rectangular side 16 has an upper groove 76 and a lower groove 78, the upper groove 76 being slightly wider than the upper side tab 48 on the rectangular ends 14, and the lower groove 78 being slightly wider than a lower side tab 50 on a rectangular end 14. Each upper groove 76 and each lower groove 78 has an inside wall 80 which has two holes 82 of slightly larger diameter than the beveled protrusion 56 on the side tab 48, 50 of an end 14 as shown in FIG. 8. The part of the inside wall 80 of a groove 76, 78 approaching a hole 82, or rather from the entrance 84 of the groove 76, 78 to the hole 82 is beveled into the inside wall 80. As shown in FIGS. 6 and 7, the preferred rectangular side 16 additionally includes a bottom tab 58 extending downwardly from the bottom edge 86 of the side 16. The bottom tab 58 is substantially co-planar to the side 16 and has a thickness slightly less than the distance which each jutting projection 36 on the base 12 is located from the center 38 of the inside face 28 of the base skirt 20. Each bottom tab 58 includes an inside face 62, and an outside face 64 which has two small cavities 66 located adjacent to the bottom edge 86 of the rectangular side 16 from which the bottom tab 58 extends.

As shown in FIG. 6 the preferred collapsible file box includes two U-shaped anti-slide file position lock pieces 88 which can be fitted snugly over the end rails 42 or the side rails 68.

Additionally, the preferred collapsible file box 10 includes a generally rectangular lid 18 which is adapted to be seated on the top edges 44, 70 of the assembled rectangular ends 14 and rectangular sides 16 to close the collapsible file box 10 as shown in FIGS. 1 and 2. The preferred rectangular lid 18 is substantially identical to the preferred rectangular base 12, except that often felt or other pads may be placed under the base 12 so that the collapsible file box will not mar surfaces on which it is placed. Furthermore, in the preferred collapsible file box 10, the rectangular lid 18 is made of transparent plastic so that the files may be seen therethrough, whereas the rectangular base 12 is made from opaque plastic.

In its use, the collapsible file box 10 shown in FIG. 1 can be of significant help to businesses, organizations, or any individuals who need a collapsible file box 10 which may be constructed quickly and used to store file papers and the like permanently or may be used to transport such papers, yet is small and convenient enough to be placed in the front seat of a car. The collapsible file box 10 may be used to contain conventional letter or legal size hanging file folders, or because it has rectangular ends 14, rectangular sides 16 and a rectangular base 12, it may be used to store other articles as well. The upwardly facing end rails 68 located on each rectangular end 14 allow the user to hang conventional legal size hanging folders thereon, and the upwardly facing side rails 68 located on the rectangular side 16 function to allow the user to hang conventional letter size hanging file folders thereon. The rectangular ends 14 are of length and height so that letter size papers may be inserted into the collapsible file box 10, and the rectangular sides 16 are of such length and height that the file box 10 may receive legal size papers. The handles 46 which are located above the center on each rectangular end 14 enable the user to easily carry the collapsible file box conveniently and in a manner which prevents the tipping of the collapsible file box 10 and the consequential spilling of the contents. The grooves 76, 78 in the rectangular sides 16 are sized to receive the side tabs 48, 50 in the rectangular ends 14. The upper side tab 48 and its corresponding upper groove 76 have a larger width than the lower side tab 50 and its corresponding lower groove 78 as shown in FIGS. 7 and 9, so that the user may assemble the rectangular ends 14 to the rectangular sides 16 only by inserting the side tabs 48, 50 into the correct corresponding grooves 76, 78. The collapsible file box 10, therefore, may be assembled only with the rectangular sides 16 and rectangular ends 14 in correct orientation to one another. When a side tab 48, 50 is inserted properly into a groove 76, 78 the beveled protrusions 56 follow along the beveling in the inside wall 80 from the entrance 84 of the groove 76, 78 and snap into the corresponding hole 82 in the inside wall 80 of the groove 76, 78 thereby locking the side tab 48, 50 into the groove 76, 78. The beveling on the protrusion 56 and the inside wall 80 allows the protrusion 56 to easily travel along the inside wall 80 when a side tab 48, 50 is being inserted into a groove 76, 78. The protrusion 56 therefore does not impede the progress of the side tab 48, 50 into the groove 76, 78.

The rectangular ends 14, rectangular sides 16 and rectangular base 12 also have a means whereby the base 12 is retained on the assembled ends 14 and sides 66. Both the rectangular ends 14 and rectangular sides 16 have bottom tabs 58 each of which fits between the two protuberances 32 on an inside face 28 of the base skirt 20 and a jutting projection 36 extending normally from the inside surface 24 of the base 12 of±set from the center 38 of the inside face 28 of the base skirt 20. The two protuberances 32 squeeze against the outside face 64 of the bottom tab 58 while the jutting projection 36 squeezes against the inside face 62 of the bottom tab 58 thereby retaining the bottom tab 58. Furthermore, the small protrusions 34 on the protuberances 32 snap into the small cavities 66 within the bottom tab 58 thereby locking the bottom tab to the rectangular base 12. When the rectangular base 12 is locked to the assembled ends 14 and sides 16 in this manner, the four cornerpiece tabs 40 on the base 12 abut the four cornering portions 72 of the side 16, thereby helping to maintain the position of the base 12 in relationship to the assembled ends 14 and sides 16.

These cornerpiece tabs 40 on the rectangular lid 18 serve much the same function when the lid 18 is placed on the assembled rectangular ends 14 and rectangular sides 16. The cornerpiece tabs 40 on the lid 18 maintain the position of the lid 18 so that the skirt edge 26 of the lid 18 rests on the top edges 44, 70 of the rectangular ends 14 and rectangular sides 16. The preferred collapsible file box 10 has two sides 16, two ends 14, a base 12 and a lid 18 with substantially closed surfaces so that when assembled, the collapsible file box 10 is substantially dustproof. Alternative embodiments of the collapsible file box 10, may have sides 16, ends 14, a base 12, or a lid 18, any of which have one or more openings therein. When disassembled the rectangular base 12, rectangular ends 14, rectangular side 16 and rectangular lid 18 may be stacked into a stack having a volume which is considerably less than that of the assembled collapsible file box 10, so that the disassembled file box 10 may be shipped or stored in a volume having a minimum of air volume. The longest dimension of this stack need only be equal to the length of the rectangular sides 16, and no longer.

Figure 3:
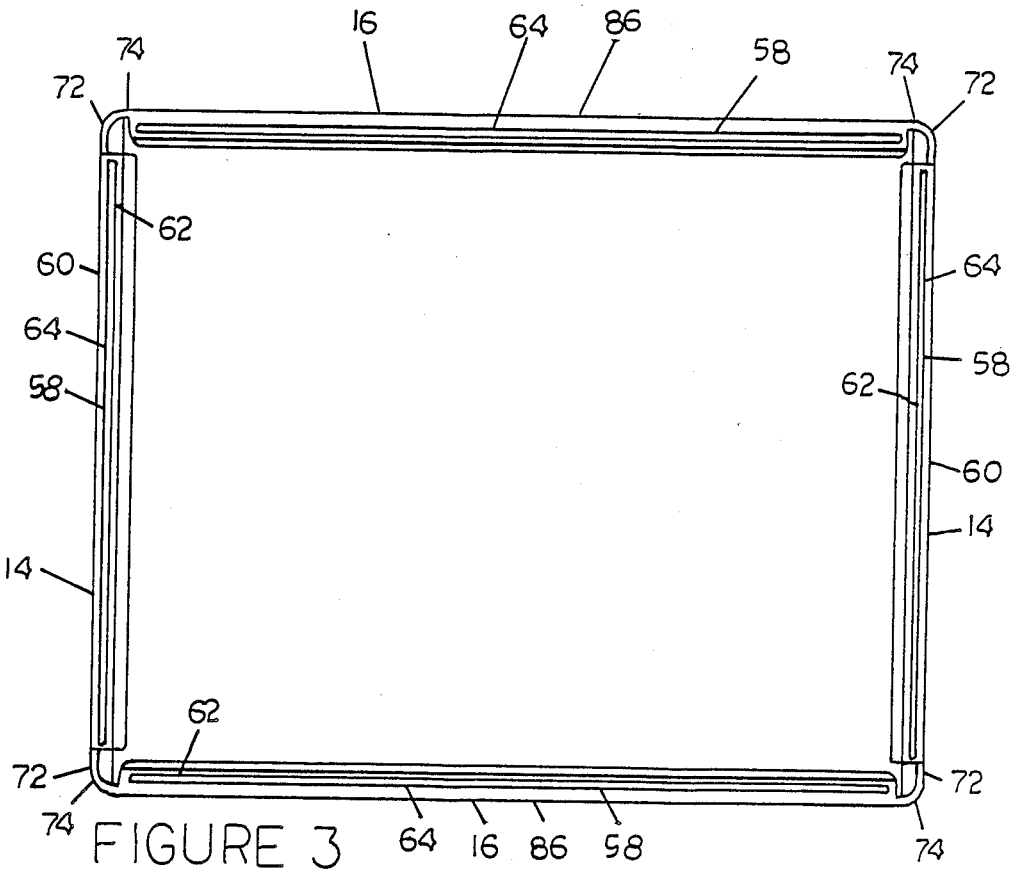
FIG. 3 is a bottom view of the two ends and two sides of the collapsible file box when assembled together.

As shown in FIG. 2, a user assembles the collapsible file box 10 by first joining the rectangular ends 14 to the rectangular sides 16, by simultaneously inserting the upper side tabs 48 into the upper grooves 76 and the lower side tabs 50 into the lower grooves 78. The resulting structure should look like that in FIG. 3 when viewed from the bottom. FIG. 3 shows the bottom tabs 58 on which the rectangular base 12 must be mounted. The user joins the rectangular base 12 to the assembled ends 14 and sides 16, making sure that the small protrusions 34 snap into the small cavities 66 thereby locking the base 12 to the ends 14 and sides 16. Turning the assembled collapsible file box 10 over, the user may now place the desired size hanging file folders on the side rails 68 or end rails 42, or place other types of files or objects into the collapsible file box 10. The two U-shaped anti-slide file position lock pieces 88 should then be placed on whichever of the end rails 42 or side rails 68 are used to suspend the hanging file folders to push the hanging folders toward one end 14 or side 16 of the file box 10, thereby holding the folders in closed position and making room for the insertion of more folders. The user may then close the collapsible file box 10 by placing the rectangular lid 18 in its proper position on the collapsible file box 10. The file box 10 may now be stored or transported as desired along with the contents therein.

It is to be understood that the present invention is not limited to the particular arrangement and embodiments of parts disclosed and illustrated herein, nor to the materials specified, but embraces all such modified forms thereof as come within the scope of the following claims.

What is claimed is:

1. A collapsible file box comprising:

(a) a rectangular base;

(b) a pair of generally rectangular ends adapted to extend vertically upwardly from the rectangular base, each end including an upper side tab and a lower side tab which both extend outwardly from each of two edges of the end in substantially co-planar relationship with the end, the upper side tabs having a different width than the lower side tabs; and (c) a pair of generally rectangular sides adapted to extend vertically upwardly from the rectangular base, each side having an upper groove and a lower groove in each of two side extremities of the side, the upper grooves being slightly wider than the vertical dimension of the upper tabs so that each upper groove may receive an upper tab, the lower grooves being slightly wider than the vertical dimension of the lower tabs so that each lower groove may receive a lower tab; wherein the upper tab and the lower tab of each edge of a rectangular end can be simultaneously inserted into only the corresponding upper groove and lower groove of an extremity of a rectangular side, so that the collapsible file box can be assembled only with the sides and ends in correct vertical orientation with respect to each other.

2. The collapsible file box specified in claim 1, further comprising a rectangular lid which is substantially structurally identical to the base, and therefore interchangeable with the base.

3. The collapsible file box specified in claim 1, wherein said sides are of a length such that an inside length of the file box is at least sufficient to receive therein papers the length of legal size paper.

4. The collapsible file box specified in claim 1, wherein said ends are of a length such that an inside width of the file box is at least sufficient to receive therein papers the length of letter size papers.

5. The collapsible file box specified in claim 1, wherein said sides and ends are of a height such that an inside height of the file box is at least sufficient to receive therein papers the width of legal and letter size papers.

6. The collapsible file box specified in claim 1, wherein the sides each include an upwardly facing side rail which is parallel to, but below a top edge of the side, so that conventional letter size hanging file folders may be hung from said side rails.

7. The collapsible file box specified in claim 1, wherein the ends each include an upwardly facing end rail which is parallel to, but below a top edge of the end, so that conventional legal size hanging file folders may be hung from said end rails.

8. The collapsible file box specified in claim 1, further including a pair of U-shaped anti-slide file position lock pieces which can be fitted snugly over the side rails to prevent the sliding of conventional letter size hanging file folders along the side rails, and over the end rails to prevent the sliding of conventional legal size hanging file folders along the end rails.

9. The collapsible file box specified in claim 1, wherein each end further includes a handle located above a center of said end member to aid in lifting the file box.

10. The collapsible file box specified in claim 1, wherein each side tab includes an inside face with at least on protrusion and each groove has an inside wall having at least one hole to receive the protrusion, so that when a side tab is inserted into a groove, each protrusion snaps into the corresponding hole in the inside wall, so that the tab is retained in the groove.

11. The collapsible file box specified in claim 10, wherein said inside wall of the groove is beveled where said protrusion approaches the hole when a side tab is inserted into a groove, and said protrusion is beveled so that the protrusion is prevented from impeding side tab insertion into the groove.

12. The collapsible file box specified in claim 2, wherein the sides, ends, base, and lid each have a substantially closed surface so that when assembled, the collapsible file box is substantially dustproof.

13. The collapsible file box specified in claim 2, wherein before assembly of the collapsible file box, said base, sides, ends and lid can be stacked on top of one another into a stack whose volume is considerably less than that of an assembled file box, so that an unassembled collapsible file box may be shipped or stored with a minimum of air volume.

14. A collapsible file box comprising:

(a) a rectangular base;

(b) a rectangular lid which is substantially structurally identical to the base, and therefore interchangeable with the base;

(c) a pair of generally rectangular ends adapted to extend vertically upwardly from the rectangular base, each end further including a plurality of side tabs extending outwardly from each of two side edges of the end; and (d) a pair of generally rectangular sides adapted to extend vertically upwardly from the rectangular base, each side having a plurality of grooves at each of two side extremities of the side to receive the tabs on the ends so that the tabs may be inserted into the grooves to assemble the collapsible file box only with the sides and ends in correct orientation to each other;

wherein each end and each side further includes a bottom tab of selected thickness extending downwardly from a bottom edge of each side and each end, the bottom tabs being substantially co-planar to the sides and ends from which they extend, said bottom tabs including an inside and an outside face and each side extremity of a side comprises a cornering portion having the upper and lower grooves;

wherein the rectangular base and the rectangular lid each further include (i) a skirt around the periphery thereof extending normally from an inside surface of the base and lid, said skirt including a skirt edge, four inside faces, and four inside corners, each inside face including a plurality of protuberances, and (ii) four jutting projections extending normally from the inside surface of said base, each jutting projection located a distance slightly greater than the thickness of the bottom tabs of the sides and, ends, inside from the center of each of the four inside faces of said skirt, (iii) four cornerpiece tabs extending normally from the inside surface of the base and lid to a distance beyond the skirt edge, each cornerpiece tab molded to one of the four inside corners of said skirt;

wherein after the two ends are securely assembled together with the two sides and then the rectangular base is seated into the bottom tabs of the sides and ends, the four cornerpiece tabs on the base abut the four cornering portions of the sides helping to maintain the position of said base, and the protuberances on each inside face of the base skirt abut against the outside face of a bottom tab, and each jutting projection on the base abuts against an inside face of a bottom tab so that the jutting projections in combination with the protuberances on the base apply a pressure to both faces of said bottom tabs, creating a friction force which helps retain the base to the bottom tabs; and wherein when the lid is seated properly on the assembled side and ends, the four cornerpiece tabs on the lid abut the four cornering portions of the sides helping to maintain the position of said lid so that the skirt edge of the lid rests on the top edges of the two ends and of the two sides.

15. The collapsible file box specified in claim 14, wherein, each protuberance on the four inside faces of said base skirt has a small protrusion normal to the inside face of the skirt near the skirt edge, and an outside face of each bottom tab has a plurality of small cavities located adjacent to the bottom edge of the member from which the bottom tab extends, each small cavity corresponding to a small protrusion which fits into the cavity so that the base is securely retained on the assembled sides and ends.

* * * * *